US005888080A

United States Patent [19]

Maejima

[11] Patent Number: 5,888,080

[45] Date of Patent: Mar. 30, 1999

[54] LOW INSERTION PRESSURE CONNECTOR

[75] Inventor: Toshio Maejima, Shizuoka, Japan

[73] Assignee: Yazaki Corporation, Tokyo, Japan

[21] Appl. No.: 833,061

[22] Filed: Apr. 3, 1997

[30] Foreign Application Priority Data

Apr. 11, 1996 [JP] Japan ..... 8-089445

[51] Int. Cl.[6] ..... H01R 13/62

[52] U.S. Cl. ..... 439/157

[58] Field of Search ..... 439/157, 159, 439/160, 347

[56] References Cited

U.S. PATENT DOCUMENTS

| | | | |
|---|---|---|---|
| 5,244,400 | 9/1993 | Hatagishi | 439/157 |
| 5,478,251 | 12/1995 | Jaklin | 439/157 |
| 5,575,676 | 11/1996 | Tsukakoshi et al. | 439/157 |
| 5,618,195 | 4/1997 | Cappe | 439/157 |

FOREIGN PATENT DOCUMENTS 61-203581 9/1986 Japan .

*Primary Examiner*—Gary Paumen

*Attorney, Agent, or Firm*—Sughrue, Mion, Zinn, Macpeak & Seas, PLLC

[57] ABSTRACT

A low insertion pressure connector including a first connector housing having driven protrusions, a second connector housing having guide grooves formed in the connector fitting direction corresponding to the driven protrusions respectively, and slide member insertion holes formed in the direction perpendicular to the connector fitting direction, a slide member having slide plates capable of being inserted into the slide member insertion holes respectively, and cam holes formed in the slide plates respectively so that each of which has first and second inclined portions to be bent into an approximate L shape. Stepped portions may be formed in the slide plates respectively, and supporting protrusions may be formed in the second connector housing so as to be capable of getting over the stepped portions to thereby support the slide plates in inclined states respectively. Inclined guide portions may be formed in the driven protrusions corresponding to inner turning points of -the cam holes respectively.

3 Claims, 7 Drawing Sheets

LOW INSERTION PRESSURE CONNECTOR

BACKGROUND OF THE INVENTION

FIELD OF THE INVENTION

This invention relates to a low insertion pressure connector which can be fitted and separated easily by the reciprocating sliding operation of a slide member.

BACKGROUND

FIGS. 10 to 11 show a conventional low insertion pressure connector disclosed in Unexamined Japanese Patent Publication No. Sho. 61-203581.

As shown in FIG. 10, a connector 40 includes a male connector 43, a slide member 45, and a female connector 48. The male connector 43 has inclined cam grooves 42 formed in housing outer walls 41. The slide member 45 has driven protrusions 44 which engage with the cam grooves 42, respectively. The female connector 48 has long holes 46 formed in housing outer walls 47 so that the driven protrusions 44 are inserted to the holes 40, respectively.

The male connector 43 is initially fitted into the female connector 48, and the slide member 45 is attached to the outside of the female connector 48 so as to be slidable in the direction of width of the connector. The driven protrusions 44 penetrate the respective long holes 46, and engage with the respective cam grooves 42. When the slide member 45 slides as shown in FIG. 11, the driven protrusions 44 relatively move along the slopes of the cam grooves 42 respectively, so that the male connector 43 is attracted to the female connector 48 so as to be fitted thereto.

In the above-mentioned conventional low insertion pressure connector 40, however, there has been a problem that the connector housing 41 is enlarged in the direction of width because of existence of the cam grooves 42 formed so as to be inclined. That is, since a large sliding force is required when the inclination angle $\alpha$ of the cam grooves 42 is set to a large value, the cam grooves 42 must be elongated in the direction of width of the housing. There arises therefore a surplus length R in the housing 47 as shown in FIG. 11.

SUMMARY OF THE INVENTION

Accordingly, an object of the present invention is to solve the foregoing problems.

It is another object of the present invention to provide a compact slide operation type low insertion pressure connector.

In order to achieve the above objects, according to an aspect of the present invention, a low insertion pressure connector includes: a first connector housing having driven protrusions; a second connector housing having guide grooves formed in the connector fitting direction corresponding to the driven protrusions respectively, and slide member insertion holes formed in the direction perpendicular to the connector fitting direction; a slide member having slide plates capable of being inserted into the slide member insertion holes respectively; and cam holes formed in the slide plates respectively so that each of which has first and second inclined portions to be bent into an approximate L shape. Stepped portions may be formed in the slide plates respectively, and supporting protrusions may be formed in the second connector housing so as to be capable of getting over the stepped portions to thereby support the slide plates in inclined states respectively. Further, inclined guide portions may be formed in the driven protrusions corresponding to inner turning points of the cam holes, respectively.

The operation on the basis of such a configuration will be described below.

When the slide member is subjected to pulling-out operation in the state where the driven protrusions are initially engaged with the respective cam holes, the driven protrusions move to the respective turning portions along the outer surfaces of the first inclined portions. The connector is half fitted by this first operation. At the same time, the supporting protrusions get over the stepped portions to incline the slide member. Consequently, the driven protrusions are enabled to enter the second inclined portions from the first inclined portions, respectively. Then, by the second operation of pushing the slide member inward, the driven protrusions move along the respective second inclined portions so that the connector is fitted perfectly. The guide portions of the respective driven protrusions make change of course of the driven protrusions at the respective turning portions surely and smoothly.

To separate the connector, first, the slide member is pulled out so that the driven protrusions move to the respective turning portions along the inner surfaces of the second inclined portions. The connector is thus half separated. The driven protrusions enter the first inclined portions along the inside of the turning portions, respectively. Then, by the operation of pushing the slide member inward, the driven protrusions move along the first inclined portions so that the connector is separated.

DETAILED DESCRIPTION OF THE PREFERRED EMBODIMENT

An embodiment of the present invention will be described below in detail with reference to FIGS. 1 to 9.

Figure 1:
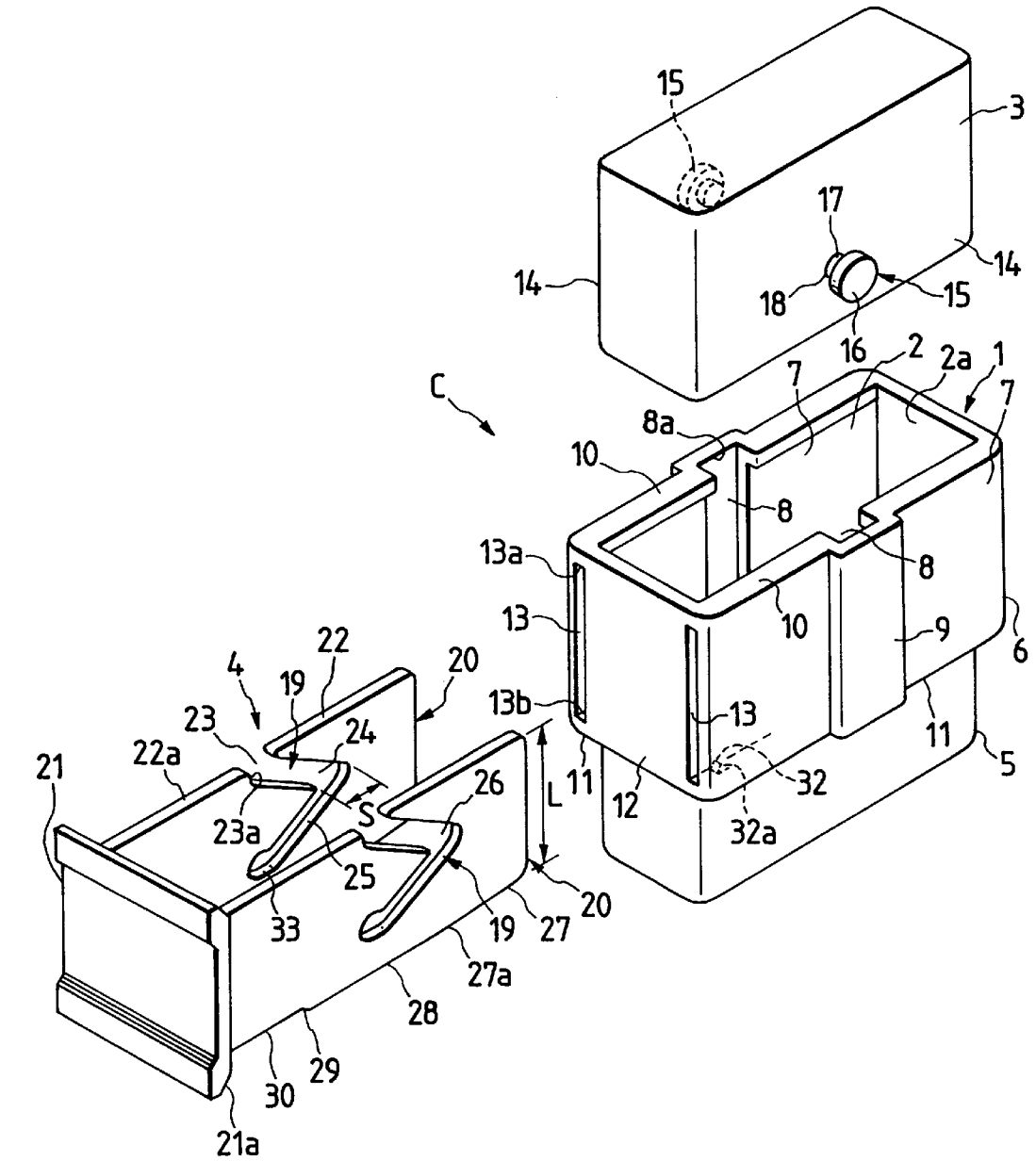
FIG. 1 is an exploded perspective view illustrating an embodiment of a low insertion pressure connector according to the present invention.
Figure 2:
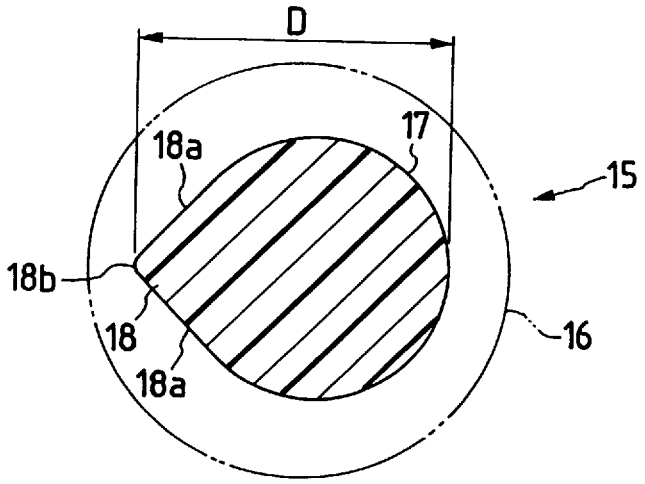
FIG. 2 is a longitudinal sectional view illustrating a driven protrusion of a male connector housing.

In FIG. 1, a female connector housing 1 has a fitting chamber 2, a male connector housing 3 which is to be inserted into the fitting chamber 2, and a slide member which is to be inserted along the opposite sides of the fitting chamber 2 in the direction perpendicular to the connector fitting direction. Not-shown terminals are inserted into the male and female connector housings 1 and 3.

The female connector housing 1 includes a terminal insertion portion 5 which is the lower half in the drawing, and a fitting portion 6 which is the upper half of the drawing and which is formed to be larger than the terminal insertion portion 5. A pair of guide grooves 8 and 8 extending in the connector fitting direction are formed in the inner surface centers of the front and rear wall portions 7 and 7 of the fitting portion 6. Each of the guide grooves 8 has an outward swelling portion 9 formed on the outer surface of the wall portion 7. Inward collar portions (collar guide walls) 10 and 10 are formed so as to project inward on the front and rear sides of an upper opening 2*a* of the fitting chamber 2. In addition, at the front and rear bottom portions of the fitting portion 6, stepped bottom walls (bottom-side guide walls) 11 and 11 are formed following the terminal insertion portion 5. Each collar portion 10 is notched so that an upper opening 8*a* of the guide groove 8 communicates with the outside.

In the opposite sides of one side wall 12 (left in the drawing) of the fitting portion 6, a pair of slit-like slide member insertion holes 13 and 13 notched in the direction of connector fitting are formed through the wall 12. The pair of insertion holes 13 and 13 are formed in parallel to each other so as to communicate with the inside of the fitting chamber 2 along the respective collar portions 10 and the respective bottom walls 11. That is, upper ends 13*a* of the respective insertion holes 13 are disposed in the same plane as the lower surfaces of the collar portions 10, and lower ends 13*b* of the respective insertion holes 13 are disposed in the same plane as the upper surface of the bottom walls 11. The slide member 4 is slidably guided between the collar portions 10 and the bottom walls 11.

The male connector housing 3 to be fitted to the female connector housing 1 has a pair of driven protrusions 15 and 15 formed on the fitting forward end sides of front and rear walls 14 and 14 so as to be received in the guide grooves 8 of the female connector housing 1 respectively. Each of the driven protrusions 15 has a disc-like large-diameter head portion 16 which is slidably engaged with the corresponding guide groove 8, and a small-diameter shaft portion 17 which is slidably engaged with a corresponding one of pair of cam holes 19 of the slide member 4 which will be described later. An approximately wedge-like guide portion (protrusion) 18 directed to the corresponding insertion hole 13 is formed on the shaft portion 17 as shown also in FIG. 2. The guide portion 18 has, in its upper and lower portions, approximately tapered or arc pick-up surfaces 18*a* and has an apex 18*b* at the intersection point of the two pick-up surfaces 18*a* and 18*a*. The inclination angle of the pick-up surface 18*a* is substantially equal to that of the corresponding cam hole 19.

The slide member 4 having the cam holes 19 to be engaged with the respective shaft portions 17 is inserted into the fitting chamber 2 through the insertion holes 13 of the female connector housing 1. The slide member 4 includes a pair of parallel slide plates 20 and 20, and an operating plate 21 coupling the respective base portions of the pair of slide plates 20 and 20 with each other. The cam holes 19 and 19 are formed respectively in an approximately inverted-L shape in the pair of slide plates 20 and 20 so as to be able to engage with the shaft portions 17 respectively.

Each of the cam holes 19 is formed narrower than the corresponding guide groove 8 and includes: an opening portion 23 opened at the approximately center portion of an upper end surface 22 of the slide plate 20; a first inclined portion 24 which extends so as to be inclined from the opening portion 23 toward the forward side of the slide plate 20; and a second inclined portion 25 which turns at the end of the first inclined portion 24, that is, at a turning point 26 and extends therefrom toward the operating plate 21 side. A downward short straight portion 23*a* is formed in the opening portion 23 so that the shaft portion 17 can enter the straight portion 23*a*. In addition, the groove width S of each hole 19 at the turning portion 26 is set to be larger than the maximum diameter D of the shaft portion 17 of the driven protrusion 15. A horizontal short lock portion 33 is formed at the end of the second inclined portion 25.

On the lower end side of each of the slide plates 20, a tapered inclined portion (slope) 27 is formed on the front end side of the slide plate 20. The height L of the slide plate 20 is made smaller gradually as it goes to the front end of the slide plate 20 due to the presence of the inclined portion 27. A start point 27*a* of the inclined portion 27 is disposed near the lower side of the turning portion 26 of the cam groove 19.

The inclined portion 27 is followed by a horizontal portion (straight portion) 28 disposed near the center of the slide plate 20. The horizontal portion 28 is parallel to the upper end surface 22 of the slide plate, and disposed almost under the cam hole 19. The horizontal portion 28 is followed by a notched portion (horizontally stepped surface) 30, through a stepped portion 29, on the base end side of the slide plate 20. In this embodiment, the inclined portion 27 is almost equal in length to the notched portion 30, and the horizontal portion 28 is formed a little longer than the inclined portion 27 or the notched portion 30. With the cam holes 19 as a boundary, the slide plate upper end surface 22 is formed so as to become higher toward the slide plate front end side, while so as to be lower by one step on the slide plate base side 22*a*. The upper end surfaces 22 and 22*a* are formed to be in parallel to each other.

On the bottom wall 11 of the fitting portion 6 of the female connector housing 1, supporting protrusions 32 which can get over the stepped portions 29 of the respective slide plates 20 are formed near the respective insertion holes 13. Each of the supporting protrusions 32 is shaped so as to have a triangular section, and has a sliding tapered surface 32*a* so that the corresponding stepped portion 29 comes into slidable contact with the tapered surface 32*a*.

The operating plate 21 of the slide member 4 is formed so as to have an area which is about equal to or a little larger than the side wall 12 of the fitting portion 6 of the female connector housing 1, and so as to be able to approach or contact with the side wall 12. Tapered thumb operation portions 21*a* are formed respectively on the upper and lower end portions of the operating plate 21.

Figure 3:
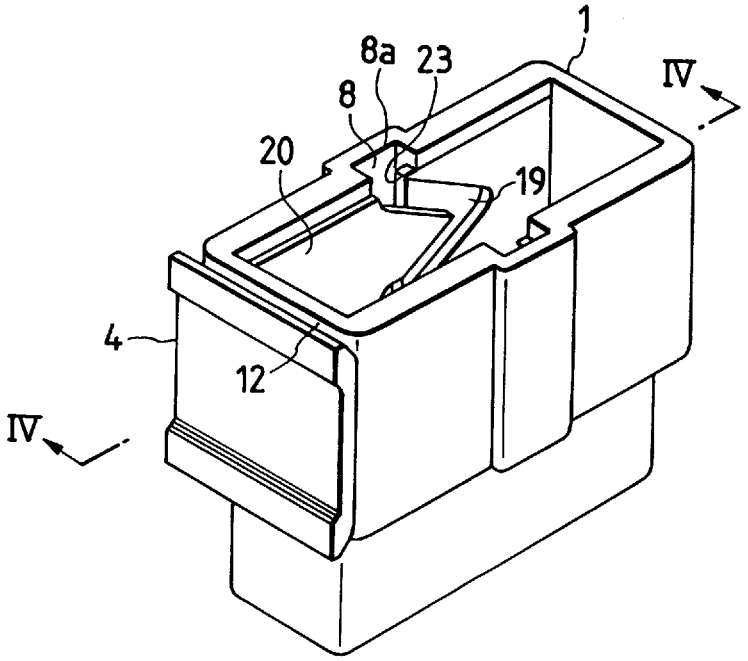
FIG. 3 is a perspective view showing the state where a slide member is inserted to a female connector housing.

FIG. 3 shows the state where the slide plates 20 of the slide member 4 are perfectly inserted into the female connector housing 1. The opening portions 23 of the respective cam holes 19 are disposed so as to communicate with slightly lower portions of the opening portions 8*a* of the respective guide grooves 8. The operating plate 21 contacts with the side wall 12.

FIGS. 4 to 7 show the procedure of fitting operation of the low insertion pressure connector C.

Figure 4:
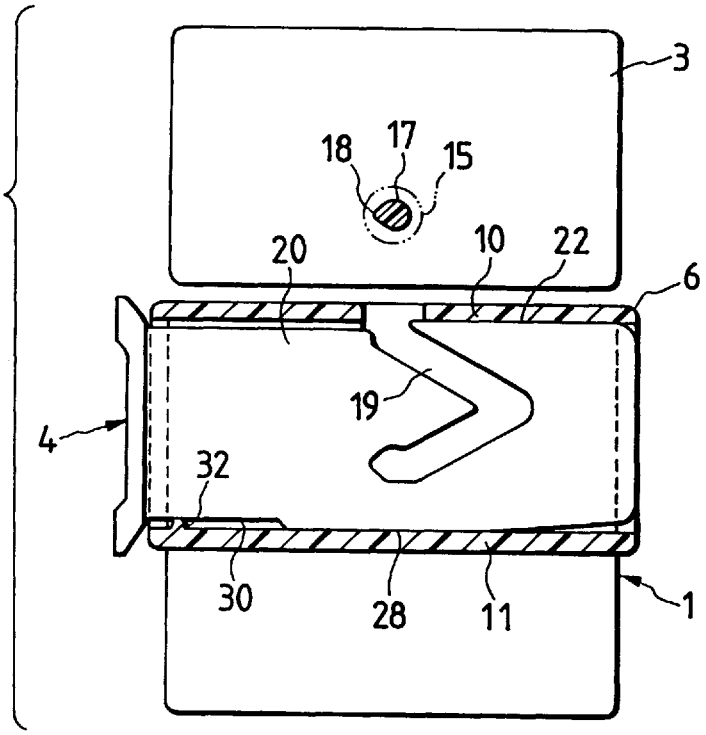
FIG. 4 is a sectional view taken on line IV—IV in FIG. 3, showing the state where the male housing is fitted to the female housing.

First, the slide member 4 is inserted into the female connector housing 1 as shown in FIG. 4. FIG. 4 corresponds to FIG. 3. The front end side upper end surfaces 22 of the slide plate 20 contacts with the collar portions 10 of the fitting portions 6, the lower side horizontal surfaces 28 at the center portion contact with the bottom wall 11, and the lower side stepped surfaces 30 contact with the supporting protrusions 32, so that the slide plates 20 are supported between the collar portions 10 and the bottom wall 11 stably.

Figure 5:
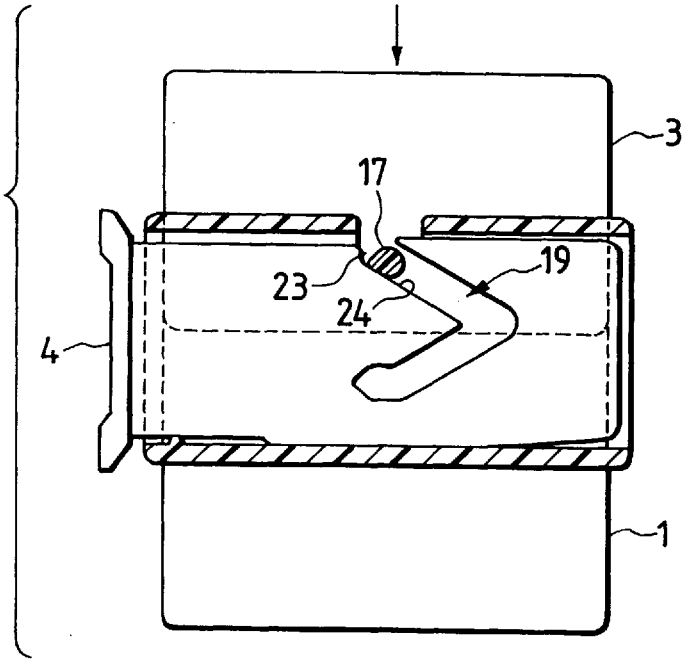
FIG. 5 is a sectional view showing the state where the male housing is initially fitted to the female housing.

Next, as shown in FIG. 5, the male connector housing 3 is initially engaged with the female connector housing 1 by hands. By this, the shaft portions 17 of the driven protrusions 15 enter the opening portions 23 of the cam holes 19 respectively. The slide member 4 projects out slightly because the first inclined portions 24 of the cam holes 19 are pushed by the shaft portions 17 respectively.

Figure 6:
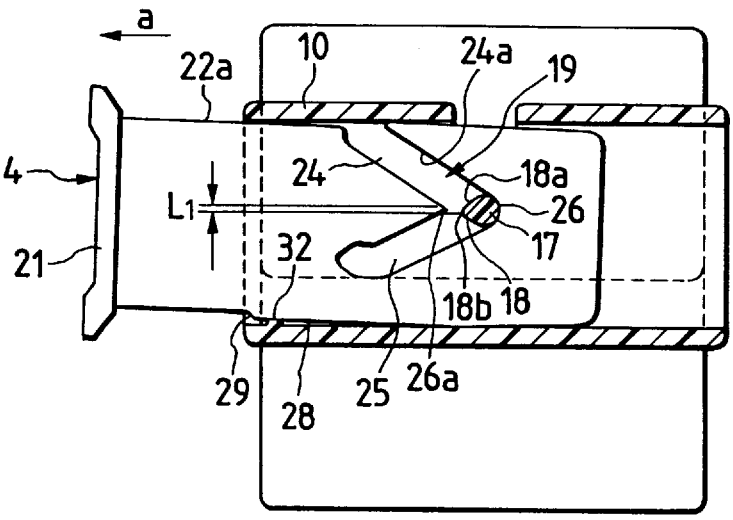
FIG. 6 is a sectional view showing the state where the slide member is pulled so that the connector is half fitted.

Next, if the slide member 4 is pulled in the direction of arrow a as shown in FIG. 6, the shaft portions 17 move down along the outside slopes 24*a* of the first inclined portions 24, and reach the turning portions 26 respectively. By this first pulling operation, the male connector housing 3 is half fitted to the female connector housing 1. At the same time the stepped portions 29 of the respective slide plates 20 get over the corresponding supporting protrusions 32, and the supporting protrusions 32 contact with the lower horizontal surfaces 28. Consequently, the slide member 4 is inclined showing a rising tendency. That is, the slide member 4 is moved up at the operating plate 21 side, while moved down at the slide plate front end side. At this time, the slide plates 20 have no interference with the collar portions 10 respectively since the base side upper end surfaces 22*a* of the slide plates 20 are lower by one step.

Because of the inclination of the slide plates 20, the respective positions of the inside turning points 26*a* of the cam holes 19 are disposed on the upper side than the center of the respective shaft 25 portions 17, that is, upper than the forward ends 18*b* of the wedged guide portions 18 respectively by a step difference $L_1$. Consequently, the shaft portions 17 can enter the second inclined portions 25 respectively. The shaft portions 17 are guided to the second inclined portions 25 by the pick-up surfaces 18*a* on the upper side of the wedged guide portions 18 surely. Although the shaft portions 17 may be guided in the turning portions 26 even if the wedged guide portions are not provided on the shaft portions, the shaft portions 17 can be guided more surely and more smoothly under the presence of the wedged guide portions 18.

Figure 7:
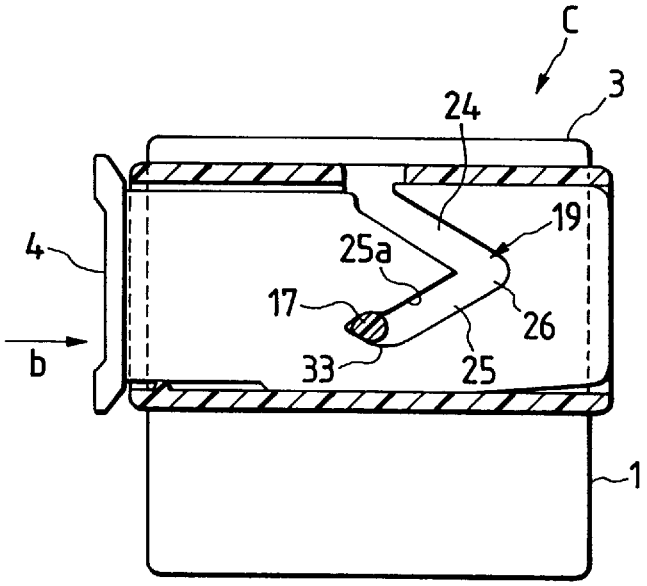
FIG. 7 is a sectional view showing the state where the slide member is pushed so that the connector is fitted perfectly.

If the slide member 4 is pushed into the female connector housing 1 in the direction of arrow b as shown in FIG. 7, the shaft portions 17 move down along the inside slopes 25*a* of the second inclined portions 25, and the male connector housing 3 is perfectly fitted to the female connector housing 1. By this second pushing-in operation, the shaft portions 17 are disposed in the lock portions 33 respectively, so that the connector housings 1 and 3 are locked with each other without any chance of separation.

Figure 8:
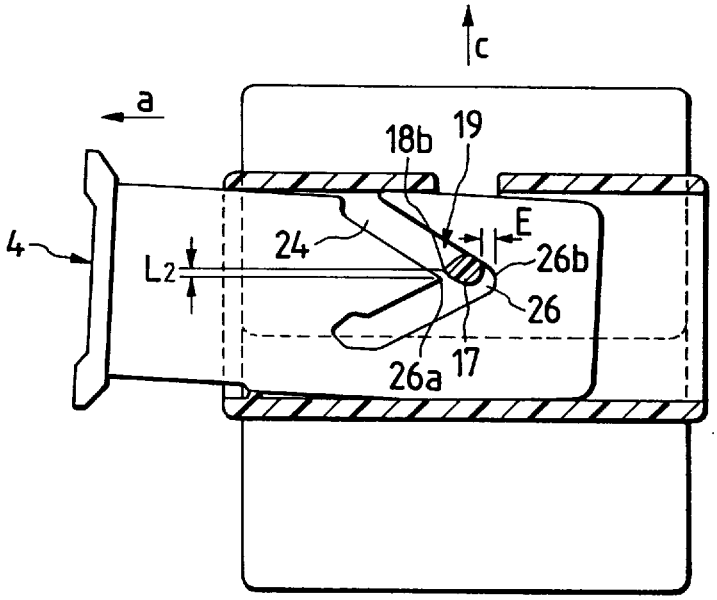
FIG. 8 is a sectional view showing the state where the slide member is pulled so that the connector is half separated.
Figure 9:
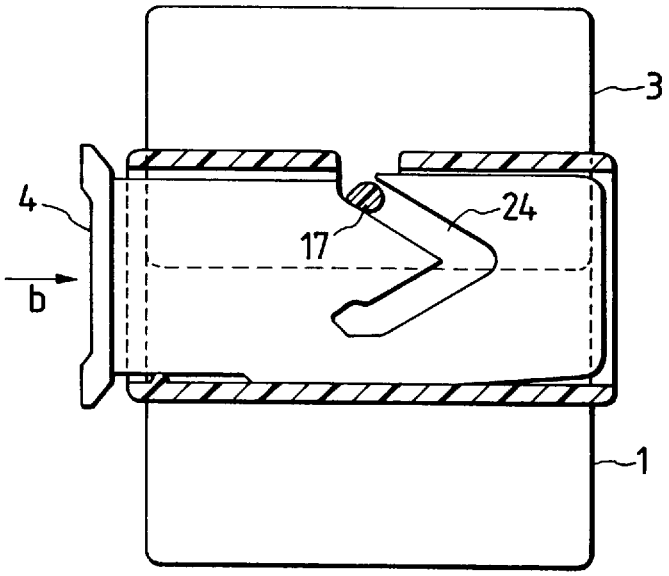
FIG. 9 is a sectional view showing the state where the slide member is pushed so that the connector is almost separated.
Figure 10:
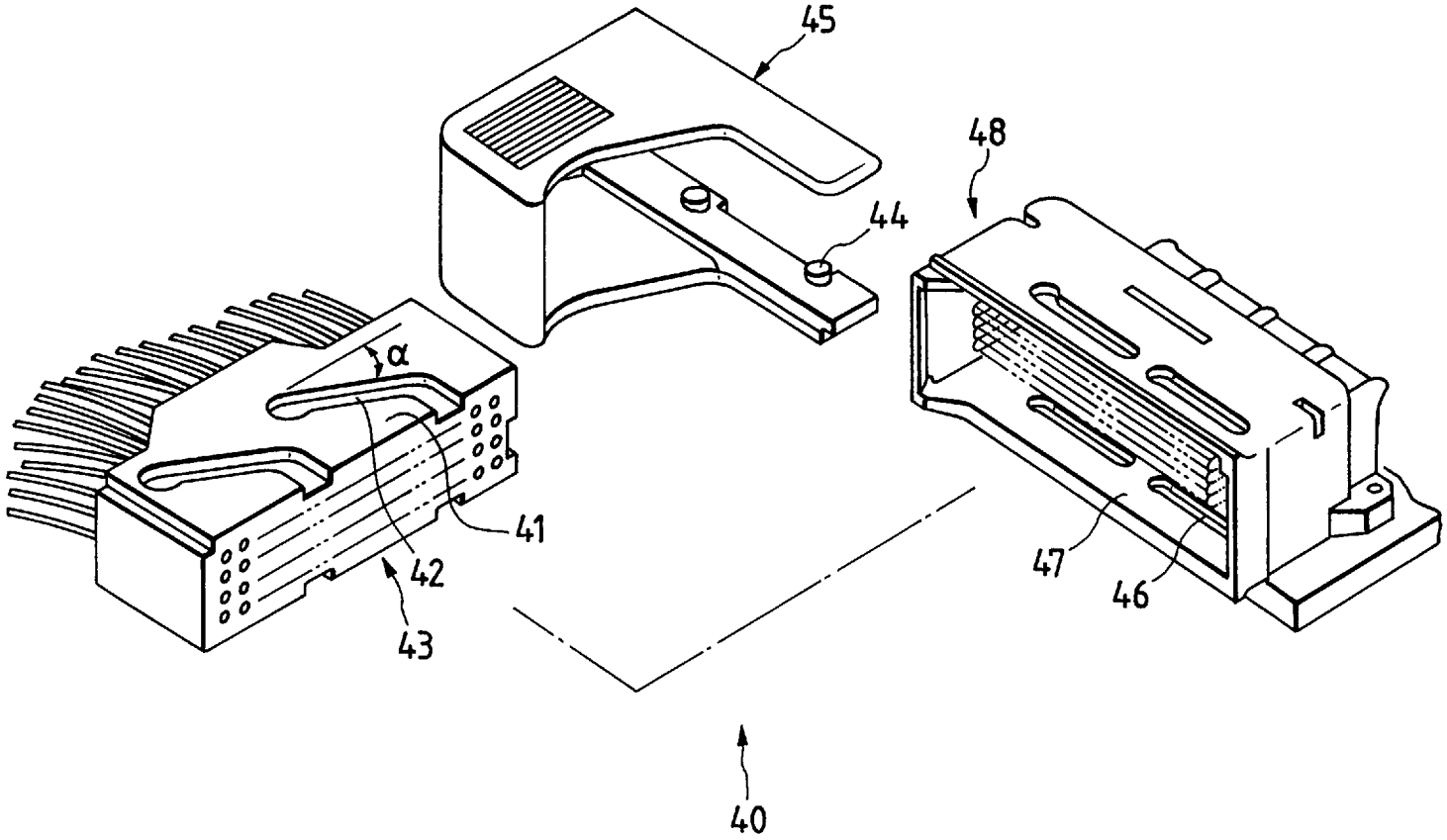
FIG. 10 PRIOR ART
FIG. 10 is an exploded perspective view illustrating an example of a conventional low-insertion pressure connector.
Figure 11:
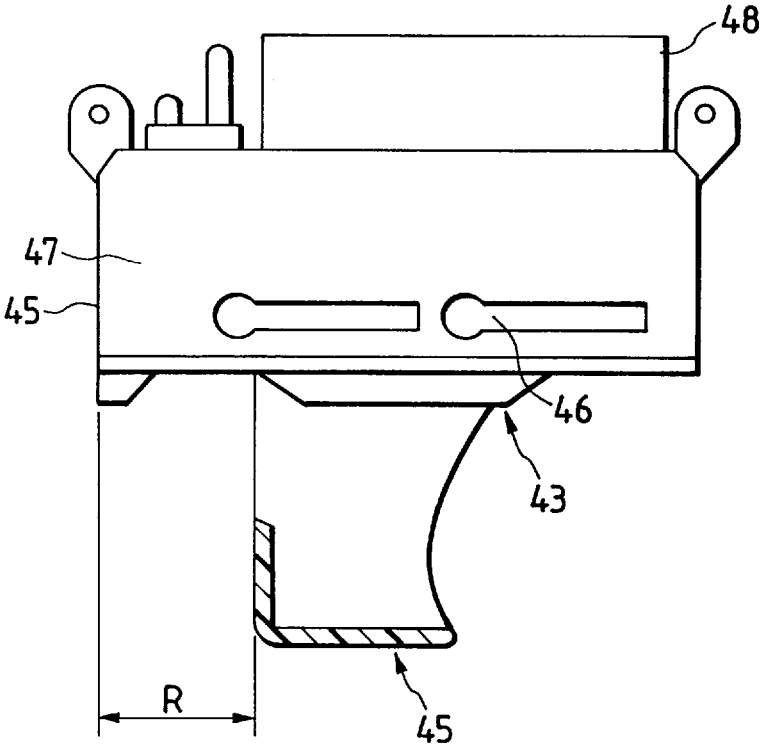
FIG. 11 PRIOR ART
FIG. 11 is a plan view showing the state where a slide member is operated in the same example.

FIGS. 8 and 9 show the procedure of separation of the low insertion pressure connector C.

First, if the slide member 4 is pulled in the direction of arrow a in the perfect fitting state shown in FIG. 7, the shaft portions 17 rise along the inside slopes 25*a* of the second inclined portions 25 of the cam holes 19 respectively, and move toward the turning portions 26. In this state, the male connector housing 3 is half separated.

The shaft portions 17 pass the turning portions 26 along the inside turning surfaces 26*a* without contacting with the outside turning surfaces 26*b*, respectively. Consequently, the shaft portions 17 are not locked in the turning portions 26 respectively, and rise while remaining the clearances E with the outside turning points 26*a*, so that the forward ends 18*b* of the wedged guide portions 18 of the shaft portions 17 are disposed in the positions upper than the inside turning points 26*a* respectively by a step difference $L_2$. Therefore, the shaft portions 17 can enter the first inclined portions 24 respectively. The male connector housing 3 may be pulled additionally in the separating direction as shown by the arrow c at the same time as the slide member 4 is pulled so as to assist passage of the shaft portions 17 through the turning portion 26 respectively.

Then, if the slide member 4 is pushed into the female connector housing 1 in the direction of arrow b as shown in FIG. 9 from the state of FIG. 8, the shaft portions 17 move up along the first inclined portions 24 respectively, and the male connector housing 3 is perfectly fitted to the female connector housing 1. By this second pushing-in operation, the shaft portions 17 are almost perfectly separated from the female connector housing 1. In this state, the male connector housing 3 can be separated by hands easily.

Without provision of the stepped portions 29 or the supporting protrusions 32 in FIG. 6, the shaft portions 17 can be made to enter the second inclined portions 25 from the turning portions 26 if the male connector housing 3 is pushed by hands on the contrary to FIG. 8 when the shaft portions 17 reach the turning portions 26 respectively.

As has been described, according to the invention, cam holes are formed respectively in an approximate L shape by first inclined portions and second inclined portions respectively, and fitting and separation of connectors are performed by a first pulling operation and a second pushing operation. Accordingly, the length of the cam holes in the direction perpendicular to the connector fitting direction can be shortened, so that connector housings can be made compact in their widthwise direction.

What is claimed is:

1. A low insertion pressure connector, comprising:

a first connector housing having driven protrusions;

a second connector housing, connected to said first connector housing, having:

guide grooves formed in a connector fitting direction, said guide grooves receiving said driven protrusions, respectively, and slide member insertion holes;

a slide member having slide plates slidably insertable into said slide member insertion holes in a direction perpendicular to the connector fitting direction, respectively; and cam holes formed in said slide plates, respectively, said cam holes having a first inclined portion and a second inclined portion formed in an approximate L shape, whereby in order to fully mate said first connector housing with said second connector housing, said driven protrusions are introduced into said cam holes of said slide member, and said first connector housing is moved such that said driven protrusions are moved along said first inclined portion of said cam holes while said slide member is moved in one direction, and then said driven protrusions are moved along said second inclined portion of said cam holes while said slide member is moved in an opposite direction.

2. The low insertion pressure connector of claim 1, further comprising stepped portions formed on said slide plates, respectively, and supporting protrusions formed in said second connector housing, wherein when said slide plates move respectively in said slide member insertion holes, said supporting protrusions support respectively said slide plate in inclined states by riding over said stepped portions.

3. The low insertion pressure connector of claim 1, further comprising inner turning points defined by intersections of said first and second inclined portions, respectively, and inclined guide portions, for guiding a movement direction in said inner turning points, formed in said driven protrusions, respectively.

* * * * *